United States Patent [19]

Ramsey

[11] 4,261,303

[45] Apr. 14, 1981

[54] AN INTERNAL COMBUSTION ENGINE

[75] Inventor: Charles R. Ramsey, Dunkirk, Ind.

[73] Assignee: Ram-Z, Inc., Dunkirk, Ind.

[21] Appl. No.: 59,304

[22] Filed: Jul. 20, 1979

[51] Int. Cl.[3] ..... F02B 59/00

[52] U.S. Cl. ..... 123/50 R; 123/47 R

[58] Field of Search ..... 123/56 AC, 56 BC, 47 R, 123/50 R, 50 A, 50 B

[56] References Cited

U.S. PATENT DOCUMENTS

| | | | |
|---|---|---|---|
| 1,281,669 | 10/1918 | Sawyer | 123/50 R |
| 1,498,216 | 6/1924 | Wade | 123/50 R |
| 4,156,410 | 5/1979 | Ramsey | 123/50 R |

*Primary Examiner*—Ronald B. Cox

*Attorney, Agent, or Firm*—Gust, Irish, Jeffers & Hoffman

[57] ABSTRACT

Improvements in an internal combustion engine comprising an elongated stationary piston having an elongated double ended movable piston coaxially mounted thereon for reciprocation. Two stationary combustion cylinders reciprocably receive the opposite ends of the movable piston, respectively. A crankshaft is journaled for rotation in the stationary piston, the axis of the crankshaft coinciding substantially with a diameter of both pistons. A crank on the crankshaft is operatively connected by means of a connecting rod to the movable piston, the connection of the rod to the movable piston being on the diameter lying in a plane which includes the axis of the crankshaft.

23 Claims, 9 Drawing Figures

AN INTERNAL COMBUSTION ENGINE

BACKGROUND OF THE INVENTION

1. Field of the Invention

The present invention relates to a reciprocating internal combustion engine and more particularly to an engine having opposed cylinders cooperatively associated with a single, double ended piston.

2. Description of the Prior Art

This invention is in an improvement over that disclosed and claimed in my U.S. Pat. No. 4,156,410 relating to an internal combustion engine. The engine therein disclosed includes a frame which carries two spaced apart axially aligned opposed cylinders. Each cylinder has a piston bore closed by a head. An elongated stationary piston has opposite ends and is carried by the frame. The stationary piston is coaxially disposed within the space defined by the bores with the opposite ends thereof being axially spaced from the respective cylinder heads. A double ended, movable piston is coaxially interposed in the cylindrical space between the stationary piston and the cylinders with the opposite end portions reciprocably slidably engaging the bores, respectively. The movable piston also reciprocably slidably engages the stationary piston and has heads on the opposite ends, each such piston head defining first and second variable volume chambers with the respective ends of the stationary piston and the cylinder head. The stationary piston is provided with a passage extending between its ends. First valve means is provided on the stationary piston for controlling fuel flow from the passage to the respective first chambers, and a fuel intake extends transversely of the movable piston and communicates with the passage. The piston heads each have an orifice provided with second valve means for controlling fuel flow between respective first and second chambers. Fuel-igniting means is mounted in each cylinder head, and means is provided for lubricating the engaged portions of the movable piston, stationary piston and the cylinder bores. Means are further provided for exhausting gases from the second chambers upon predetermined movement of the piston heads from the respective cylinder heads. The second valve means closes the respective orifices when the gaseous pressure in the second chambers is greater than that in the first chambers. The second valve means also opens such orifices in response to such predetermined movement of the piston heads whereby compressed fuel in the first chambers will flow into the second chambers. The first valve means closes communication between the first chambers and the passage, respectively, when the pressure in the first chambers exceeds that in the passage as a result of the piston heads moving toward the respective ends of the stationary piston, and opens communication when the pressure in the passage exceeds that in the first chambers as a result of the piston heads moving away from the respective ends of the stationary pistons. Means are provided for converting reciprocatory motion of the movable piston into rotary motion. Similar prior art engines are disclosed in U.S. Pat. Nos. 1,756,354, 2,319,427 and 2,385,457.

SUMMARY OF THE INVENTION

The internal combustion engine of the present invention comprises an elongated stationary piston having an elongated double ended movable piston reciprocably mounted thereon. Two opposed stationary combustion cylinders reciprocably receive the opposite ends of the movable piston, respectively. A crankshaft is journaled for rotation through the stationary piston, the axis of the crankshaft coinciding substantially with a diameter of both pistons. A crank on the crankshaft is connected to the movable piston by means of a connecting rod, the connection of this rod with the movable piston being on a diameter of the latter which lies in a plane including the axis of the crankshaft itself.

The crankshaft may be provided with two cranks located on opposite sides of the two pistons, the connecting rods connecting these cranks to the movable piston. A crankcase or housing encloses the midportions of the pistons, the crank arms and the point of connection of the connecting rods to the movable piston. The housing is provided with first opposed sides within which opposite end portions of the crankshaft are journaled. A frame element secured to the housing also serves to secure the stationary piston rigidly in place. The movable piston is provided with longitudinally extending clearance slots on diametrically opposite sides thereof which receive the crankshaft whereby the movable piston may reciprocate relative to the stationary piston as well as the crankshaft.

It is an object of the present invention to provide improvements in an internal combustion engine having a double ended piston wherein the crankshaft and its connection to the piston is mounted substantially in a common plane which includes the longitudinal axis of the piston.

Another object of this invention is to provide such improvements which contribute toward reducing engine size and increasing the horsepower to weight ratio.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
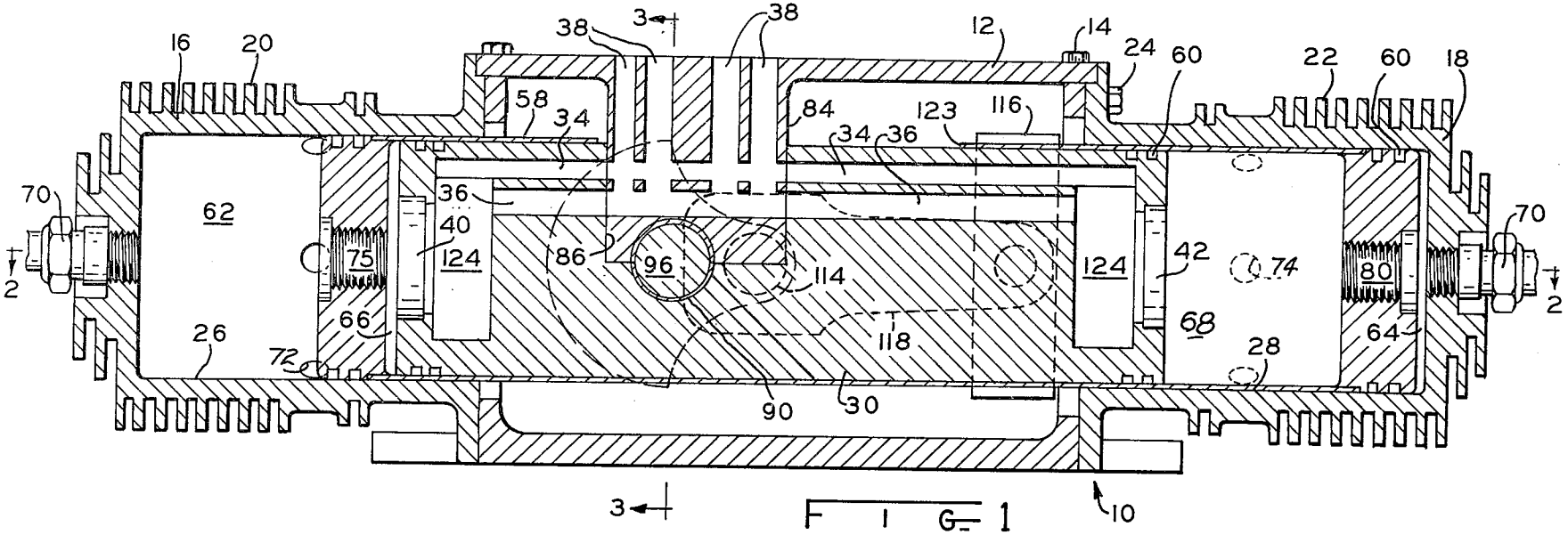
FIG. 1 is a longitudinal section of one embodiment of this invention.

Referring to the drawings, the engine crankcase or housing is indicated generally by the reference numeral 10 which includes a cover 12 secured thereto by means of screws 14. A pair of opposed cylinders 16 and 18, having cooling fins 20 and 22, are attached to the housing 10 by means of screws 24 such that their bores 26 and 28 are coaxial.

Figure 8:
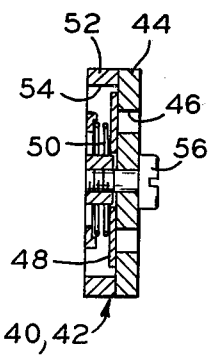
FIG. 8 is a cross section taken substantially along section line 8—8 of FIG 7.
Figure 7:
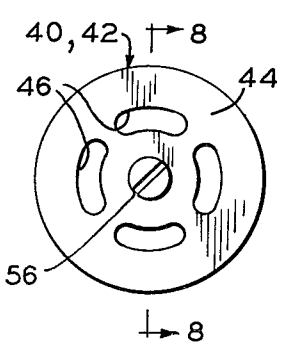
FIG. 7 is a rear view thereof.
Figure 6:
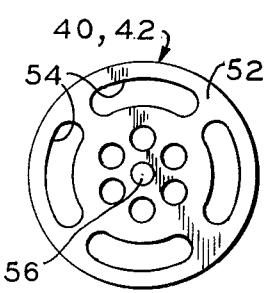
FIG. 6 is a front view of the check valve mounted in the ends of the stationary piston.
Figure 2:
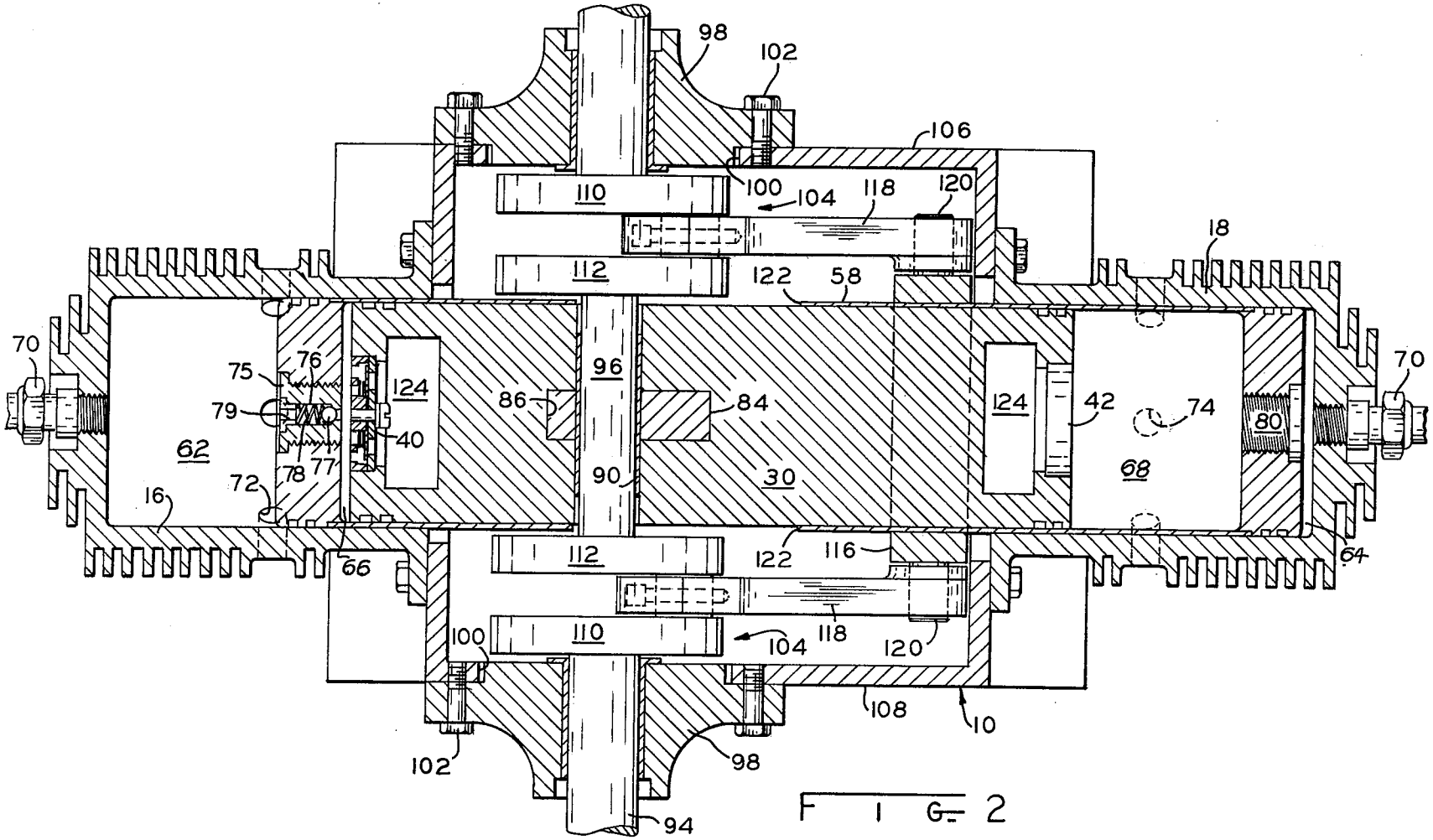
FIG. 2 is another longitudinal section taken substantially along section line 2—2 of FIG. 1.
Figure 5:
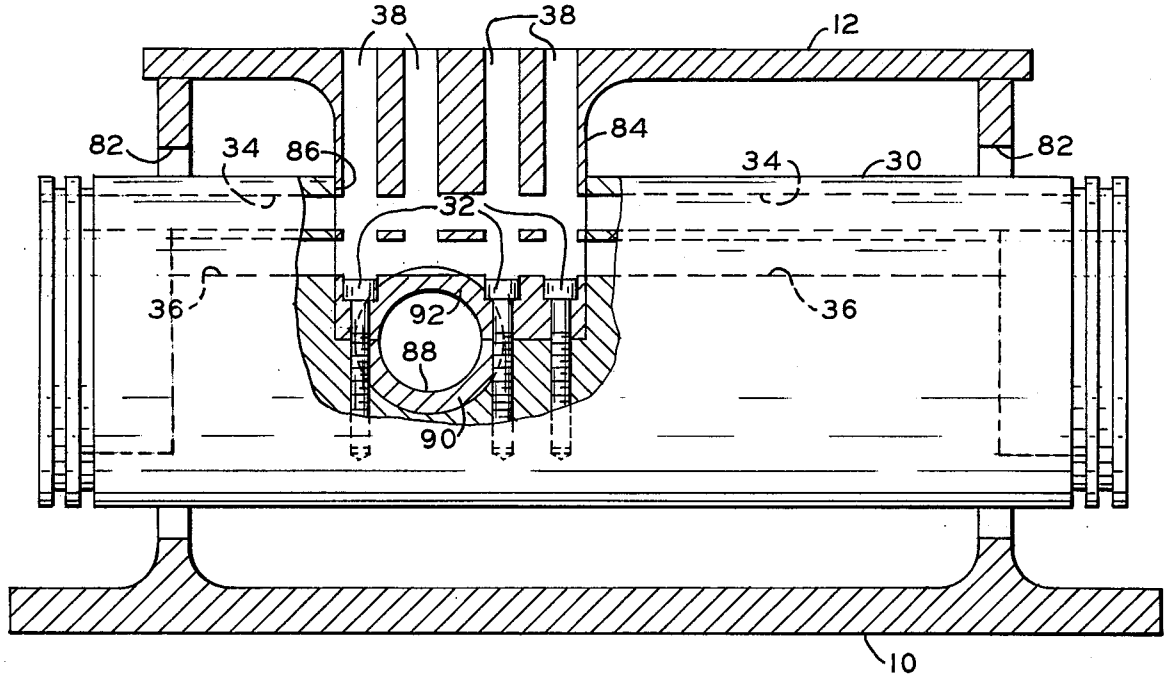
FIG. 5 is a longitudinal section of the crankcase showing the stationary piston assembled thereto.

Received within the housing 10 and cylinders 16 and 18 is a stationary internal piston 30 which is rigidly secured to housing cover 12 by means of three screws 32 (see FIG. 5). Stationary piston 30 includes a pair of vertically spaced parallel fluid passages 34 and 36 which lead from carburetor throat passages 38 formed in cover 12 to the opposite ends of piston 30, passages 34 and 36 being opened and closed by means of check valves 40 and 42 resiliently biased closed. Such check valves 40 and 42 are opened when the pressure within passages 34 and 36 becomes sufficiently greater than that on the opposite sides thereof to overcome the spring force holding the valves closed. Such check valves 40, 42 are identically constructed and are shown in FIGS. 6–8. Each valve is composed of a first disc 44 having a circle of arcuate slots and apertures 46. A flat, washer-like valve 48 is resiliently urged against the side of the disc 44 in overlying relation to the apertures 46, a helically coiled compression spring 50 being interposed between valve 48 and another disc 52 having a rim portion engaged in sealing relation with the outer marginal portion of the disc 44. The disc 52 is provided with a series of arcuate openings 54 in a thinner central section thereof engaged by the helical spring 50. The valve 48 can thus move from the closed position shown in FIG. 8 toward the disc 52 thereby to provide communication between the openings 54 and apertures 46. A threaded fastener 56 secures the two discs 44 and 52 together.

Reciprocably slidably received within cylinders 16 and 18 and over stationary piston 30 is an elongated double ended cylindrical movable piston 58. Piston rings 60 are fitted between the movable piston 58, the stationary piston 30 and the two cylinders 16 and 18 as shown. A combustion chamber 62 is formed between cylinder 16 and movable piston 58 at one end of the engine and a second combustion chamber 64 is formed between cylinder 18 and movable piston 58 at the other end. A first compression chamber 66 is formed internally of piston 58 between it and one end of stationary piston 30, and a second compression chamber 68 is similarly formed at the other end of stationary piston 30. Spark plugs 70 or other suitable ignition devices are threaded into the heads of the two cylinders 16 and 18. A plurality of circumferentially arranged exhaust ports 72 extend through the wall of cylinder 16 and similarly positioned exhaust ports 74 extend through the wall of cylinder 18.

A one-way check valve 75 is threaded into the left end of the movable piston 58 as shown and is provided with an axially extending bore 76 provided with a seat onto which a ball valve 77 is seated to close bore 76. A helical compression, valve spring 78 bears at one end against the ball valve 77 and at its other end against a nozzle-like insert 79 press fitted into the end of the bore 76. The ball valve 77 will unseat and open the bore 76 when the pressure within compression chamber 66 becoms sufficiently greater than the pressure within combustion chamber 62 to overcome the force of spring 78. The passage through the nozzle insert 79 serves to direct the fuel mixture toward the spark plug 70.

Figure 9:
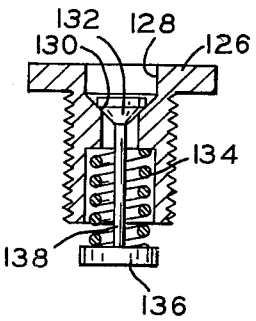
FIG. 9 is an axial sectional view of a one-way check valve for use in the heads of the movable piston, this design being different than the one shown in the preceding figures.

An alternative design of check valve is shown in FIG. 9 which includes an externally threaded element 126 having a stepped diameter bore 128 provided with a tapered valve seat 130. A coincally shaped valve 132 is normally engaged with the seat 130 by means of a helical compression valve spring 134 engaged at one end with a shoulder in the bore 128 and at the other end with an abutment element 136 secured to the stem 136 of the valve 132. Valve operation is essentially the same as that for the valve 75 except that the abutment 136 may be engageable with the adjacent end of the stationary piston 30 upon closure of the head of the movable piston 58 onto the stationary piston which will result in opening of the valve 132.

A second check valve assembly 80 like that of valve 75 is fitted into the righthand end of the movable piston 58 for controlling the injection of fuel from compression chamber 68 into combustion chamber 64.

As shown in FIG. 5, stationary piston 30 is secured to the cover 12 in such position that the opposite ends thereof project with clearance through openings 82 in the opposite walls of the housing 10. In order to secure the stationary piston 30 in this position, a rectangular projection 84 integrally formed with the cover 12 is slidably fitted into a semicylindrical cut-out 86 in the stationary piston 30. The four carburetor throat passages 38 are located within this projection 84, the threaded fasteners 32 being located in the bottoms of three of these.

Figure 4:
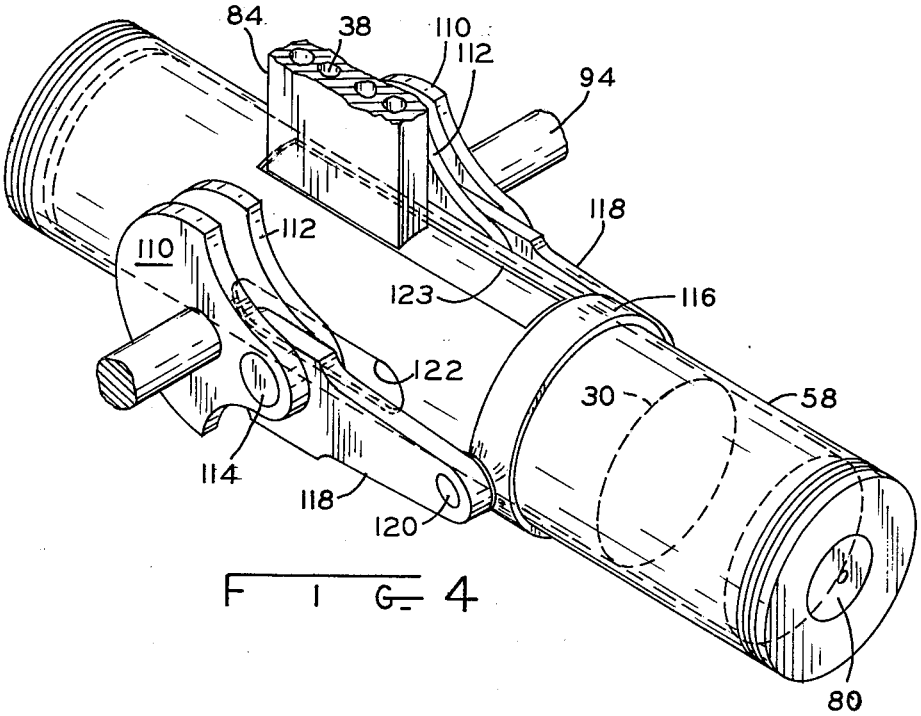
FIG. 4 is a perspective illustration of the crankshaft and movable piston assembly.

In the bottom of the cut-out 86 and in the lower end of the projection 84 are formed mating halves of a bearing opening 88 further defined by two halves 90 and 92 of a sleeve bearing. A crankshaft 94 is mounted within the housing 10 with the central portion 96 being received by sleeve bearing 90, 92 and the end portions by means of bearing pads 98 secured within openings 100 of the housing 10 by means of threaded fasteners 102. Two cranks in phase, indicated generally by the numeral 104, on the crankshaft 94 are disposed, respectively, between the movable piston 58 and the housing walls 106, 108, respectively. Each of the cranks 104 includes two spaced counterweights 110 and 112 having fitted therebetween respective crank pins 104 (FIGS. 1 and 4).

In order to connect the movable piston 58 to the crank pins 114, an annular yoke or trunnion 116 is coaxially secured to the periphery of the piston 58. This securement may be provided by means of welding, a suitable adhesive, or a threaded connection between the yoke and the piston.

Two connecting rods 118 are connected between the crank pins 114 and respective wrist pins 120 extending diametrically from the yoke 116. The movable piston 58 is provided in diametrically opposite sides with two longitudinally extending slots 122 which receive the opposite ends of the crankshaft portion 96 as shown. Another longitudinally extending slot 123 (FIGS. 1 and 4) receives the projection 84 with clearance. Thus, as the crankshaft 94 is rotated, the movable piston 58 may be reciprocated with the slots 122 and 123 clearing the crankshaft portion 96 and projection 84. The housing 10 is supplied with a quantity of lubricating oil which is splashed around piston 58 as the crankshaft 94 rotates. This lubricating oil penetrates between the sliding surfaces between the movable piston 58, the stationary piston 30 and the two cylinders 16 and 18 to provide for lubrication.

Further with respct to the design of the crankshaft and its connection with the movable piston 58, the axis of the crankshaft 94 is disposed to coincide with a common diameter of the two pistons 30 and 58 as is the axis of the two wrist pins 120. Further, these two axes lie in a common plane which includes the axis of the two pistons.

Within the opposite ends of the stationary piston 30 is provided two enlarged fuel cavities 124 to which are connected the opposite ends of the passages 34 and 36. These cavities 124 serve as reservoirs for the air/fuel mixture to be introduced into the respective compression chambers 66 and 68 at the appropriate cycles of engine operation. This will be explained in more detail later.

Assuming initially that the movable piston 58 is in the position shown in FIG. 1 and that spark plugs 70 on the righthand side has just fired thereby igniting the compressed fuel mixture in combustion chamber 64, the piston 58 will be driven to the left. Since the pressure caused by the exploding mixture in this combustion chamber 64 will be greater than the pressure in compression chamber 68, check valve 80 will be closed and the fresh air/fuel mixture in chamber 68 will be compressed as the chamber 68 is reduced in volume. At the same time, the opposite end of piston 58 will be driven toward the left thereby compressing the fresh air/fuel mixture within the combustion chamber 62 and causing compression chamber 66 to enlarge as the piston head moves away from the left end of stationary piston 30. Since the pressure within combustion chamber 62 is greater than that in compression chamber 66, check valve 75 will be closed thereby resulting in reduction of pressure within compression chamber 66 which draws an air/fuel charge from carburetor 126 through passages 34 and 36. This reduced pressure in compression chamber 66 causes valve 48 (FIG. 8) to unseat thereby admitting the fresh fuel charge into chamber 66.

Returning to cylinder 18, as piston 58 is driven toward the left, it will clear exhaust ports 74 at or very near the end of its power stroke thereby permitting the spent gasses to vent to atmosphere. When this occurs, the pressure within the combustion chamber 64 drops substantially below the pressure within the compression chamber 68, which by this time is increased due to the compression of the fuel charge. This causes check valve 80 to open permitting the compressed charge to be injected into combustion chamber 64 through the nozzle of the valve 80.

As cylinder 18 is being scavenged, and the new charge is injected through the nozzle as just explained, spark plug 70 on the left will fire thereby igniting the fuel charge which has been compressed in combustion chamber 62. This drives piston 58 toward the right, compressing the fuel charge which was previously drawn into the compression chamber 66 and compressing the fuel charge which has just been injected into combustion chamber 64.

In this manner, cylinders 16 and 18 are alternately fired 180° out of phase and the reciprocating motion of piston 58 is transmitted to the crankshaft 94 through the connecting rods 118.

In order to assure delivery of a fuel mixture into the compression chambers 66 and 68, fuel cavities 124 of relatively large size are provided in the end portions of the stationary piston 30. These cavities 124 are disposed immediately adjacent to the valves 40 and 42 such that upon opening of these valves, fuel from the cavities 124 may be directly transferred to the compression chambers 66 and 68, respectively. Thus, the compression chambers are not starved for fuel by reason of lack of fuel supply in the fuel-metering system, since such supply is constantly maintained during engine operation.

Figure 3:
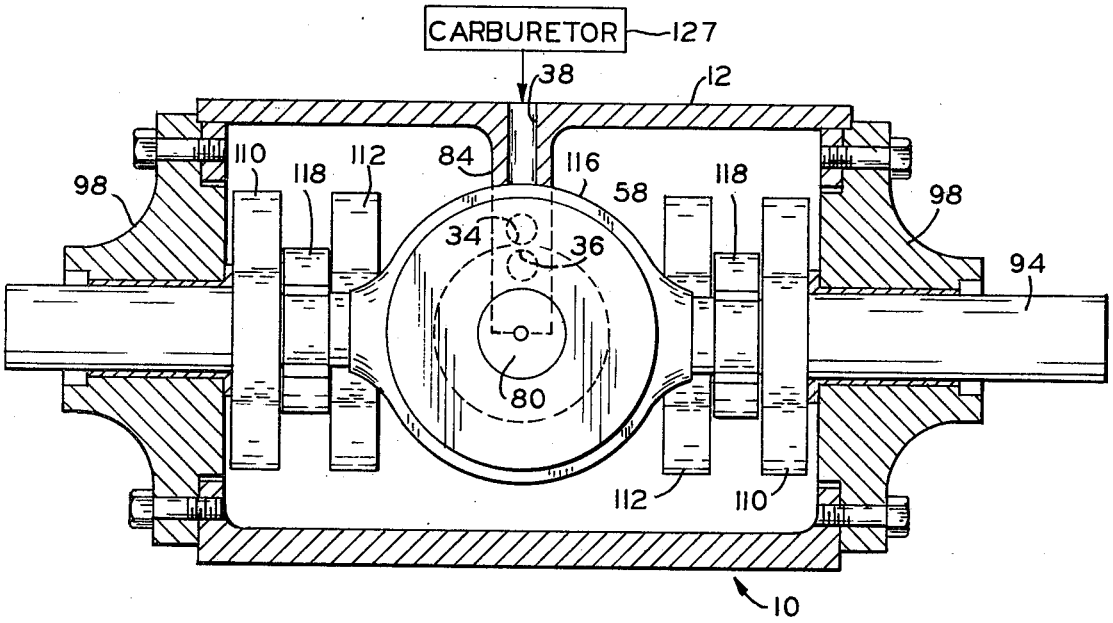
FIG. 3 is a cross section taken substantially along section line 3—3 of FIG. 1 through the crankcase but showing an end of the movable piston.

In the fuel metering system, the carburetor throats 38 and passages 34 and 36 are formed by drilling so that upon assembly of the cover 12, and more particularly the projection 84 to the stationary piston 30, these throats and passages line up as shown in FIG. 1. The projection 84 is of a width as shown in FIG. 1 as provides a close, sliding fit with the opposite walls of the cut-out 86 in the stationary piston to provide a seal between the passages 34, 36 and the carburetor throats 38 where they meet. Any suitable type of fuel-metering device, such as a carburetor, may be connected to the throats 38, as indicated in FIG. 3. A crankcase breather may be provided as clearly disclosed in my prior U.S. Pat. No. 4,156,410, such disclosure being included herein by reference. Suitable ignition circuitry and timing mechanism, not shown, may be connected to the crankshaft 94 for assuring firing of the two spark plugs 70 at the appropriate time in the reciprocation of the piston 58.

Locating the crankshaft centrally of the piston assembly provides a number of advantages. In the engine of my prior U.S. Pat. No. 4,156,410, the crankshaft is laterally offset resulting in side loads which impart bending moments to the movable piston. This piston therefor must be made suitably strong to withstand these loads. In this invention, with the crankshaft centrally positioned, such side loads are essentially eliminated whereby the wall thickness and weight of the piston may be reduced.

As to the arrangement of the aforesaid U.S. Pat. No. 4,156,410, adequate clearances must be provided between the crankshaft and its connecting rod on the one hand and the piston on the other, such clearances determining the extent of such offset. Greater clearances are required upon increasing counterweight and connecting rod sizes in order to accommodate piston movement, thereby requiring a corresponding increase in engine height. Thus a compromise is necessary between the degree of offset desired and the strength and sizes of the crank assembly. Providing such clearances is obviously not so restricted in the present invention since the crankshaft is centrally located and the connecting rods extend alongside in parallelism with the piston. The over all engine height may thus be shorter.

Wrist pin diameter, hence strength, must be compromised in the former design since the larger the diameter the larger the attaching portion of the connecting rod must be. This requires more offset spacing of the crankshaft. In this invention, the wrist pin diameter can be suitably enlarged along with utilization of larger connecting rods without encountering such offset spacing problems.

Side loads imparted by an offset crankshaft produces greater friction in the sliding movement of the movable piston against the stationary piston and the walls of the cylinders. Obviously, such additional friction is substantially reduced or entirely eliminated in this invention, providing for increased wear life and reduced lubrication requirements.

The centrally located crankshaft serves in locating and holding the stationary piston in the assembly since separate portions of the shaft are journaled in both the piston and the frame (projection 84). The use of two wrist pins 120 and connecting rods 118 further stabilizes the movable piston 58 against rotation about the stationary piston 30 as compared with the single wrist pin arrangement of my former design.

The timing of the engine is more uniform, hence made simpler, in this invention, since for each 180° of rotation of the crankshaft, the two piston heads, respectively, are disposed at top dead center in contrast with one of the heads of my former design being at something other than top dead center for one such 180° position. In my former design, assuming one head to be at top dead center for the zero degree (0°) position, the crankshaft must be rotated to a position of one hundred eighty six degrees (186°), for example, for the other piston head to be at top dead center. Such non-uniformity requires a special adjustment in a distributor connected to the crankshaft in order to obtain the correct timing in firing the spark plugs. Timing of the engine herein is thus simplified.

Vibratory problems due to the offset crankshaft, the counterweights and connecting rods are substantially minimized or eliminated by the present invention. Consequent smoother engine operation and reduced stresses lead to greater wear life and durability.

While there have been described above the principles of this invention in connection with specific apparatus, it is to be clearly understood that this description is made only by way of example and not as a limitation to the scope of the invention.

What is claimed is:

1. For use in an internal combustion engine, apparatus comprising a frame which carries two spaced apart axially aligned opposed cylinders, each cylinder having a piston bore, an elongated stationary piston carried by said frame, said stationary piston being disposed within the space defined by said bores, a movable double ended piston slidably interposed between said stationary piston and said cylinder bores, respectively, and means for converting reciprocatory motion of said movable piston into rotary motion; said converting means including a crankshaft extending transversely of said stationary piston intermediate the ends of the latter and having portions journaled for rotation in said frame and stationary piston, a crank on said crankshaft disposed between said stationary piston and said frame, and a connecting rod operatively connected between said crank and said movable piston whereby reciprocating motion of said movable piston results in rotation of said crank and crankshaft.

2. The apparatus of claim 1 wherein the point of pivotal connection of said rod with said movable piston lies on a diameter thereof in a plane which includes the axis of said crankshaft.

3. The apparatus of claim 1 wherein said shaft has opposite end portions journaled in said frame and a central portion mounted for rotation in said stationary piston, two cranks on said crankshaft on opposite sides, respectively, of said stationary piston, and two connecting rods operatively connected between said cranks and said movable piston whereby reciprocating motion of said movable piston results in rotary motion of said crankshaft.

4. The apparatus of claim 3 wherein said frame includes a housing which mounts said opposed cylinders, said opposite end portions being journaled in spaced housing sides with said pistons being disposed in spaced relation therebetween, and said two cranks being between said pistons and said sides, respectively.

5. The apparatus of claim 4 wherein said stationary piston has a radially extending cavity intermediate its ends which opens through one side thereof, a first part-cylindrical bearing portion in the bottom of said cavity having an axis coincident with a diameter of said stationary piston, a frame element secured within said cavity and having a second part-cylindrical bearing portion juxtaposed with said first bearing portion to thereby form a journal bearing support for said central portion of said crankshaft, and said frame element being rigidly secured to said housing.

6. The apparatus of claim 3 wherein said connecting rods are pivotally connected to said movable piston by means of a surrounding annular yoke secured thereto, said yoke having diametrally opposed wrist pins in axial alignment with the axes thereof coincident with a diameter of said movable piston, said diameter lying in a plane which includes the axis of the central portion of said crankshaft.

7. The apparatus of claim 6 wherein said frame is in the form of a housing which encloses the central portion of said movable piston, said yoke and said cranks, opposite sides of said housing supporting journal bearings for said end portions of said crankshaft.

8. The apparatus of claim 7 wherein said housing is closed to thereby serve as a crankcase for lubricant.

9. The apparatus of claim 7 wherein said cranks are positioned in phase on said crankshaft.

10. The apparatus of claim 3 wherein said movable piston is of uniform diameter and provided with axially extending slots on diametrically opposite sides thereof, said slots receiving said central portion of said crankshaft therethrough.

11. For use in an internal combustion engine, apparatus comprising a frame which carries two spaced apart axially aligned opposed cylinders, each cylinder having a piston bore and closed by a head, an elongated stationary piston having opposite ends and carried by said frame, said stationary piston being disposed within the space defined by said bores and radially spaced therefrom, the opposite ends of said stationary piston being axially spaced from the heads of the respective cylinders, a movable piston interposed in the space between said stationary piston and said cylinders with the opposite end portions thereof reciprocably slidably engaging said bores, respectively, said movable piston also reciprocably slidably engaging said stationary piston and having heads on the opposite ends thereof, each piston head defining first and second variable volume chambers with the respective end of said stationary piston and the respective cylinder head, said stationary piston having a passage extending between the end portions thereof, first valve means on said stationary piston for controlling fuel flow from said passage to the respective first chambers as defined between the ends of said stationary piston and the respective piston heads, means providing a fuel intake which communicates with said passage, said piston heads each having an orifice therethrough, second valve means engageable with each orifice for controlling fuel flow between respective first and second chambers, fuel-igniting means mounted in each cylinder head, means for exhausting gases from said second chambers upon predetermined movement of said piston heads from the respective cylinder heads, said second valve means closing the respective orifices when the gaseous pressure in said second chambers is greater than that in the first chambers, respectively, and opening such orifices in response to said predetermined movement of said piston heads whereby compressed fuel in the first chambers will flow into the second chambers, respectively, said first valve means closing communication between the first chambers and said passage, respectively, when the pressure in the first chambers exceeds that in said passage as a result of the piston heads moving toward the respective ends of said stationary piston and opening communication when the pressure in said passage exceeds that in said first chambers as a result of the piston heads moving away from the respective ends of said stationary piston, means for converting reciprocatory motion of said movable piston into rotary motion, and said stationary piston having fuel cavities within the opposite end portions thereof which communicate with said passage, and lie between the passage ends and the ends, respectively, of the stationary piston, said first valve means controlling the flow of fuel from said cavities into said first chambers, said first valve means including a one-way check valve in each end of said stationary piston.

12. Apparatus for use in an internal combustion engine comprising an elongated stationary piston having an elongated double ended movable piston reciprocably mounted thereon, two opposed stationary combustion cylinders reciprocably receiving the opposite ends of said movable piston, respectively, a crankshaft journaled for rotation in said stationary piston, the axis of said crankshaft coinciding substantially with a diameter of said stationary and movable pistons, a crank on said crankshaft, and a connecting rod operatively connected at one end to said crank and at the other end to said movable piston, the connection of said rod to said movable piston being on a diameter thereof lying in a plane which includes the axis of said crankshaft.

13. The apparatus of claim 12 wherein said crankshaft has two cranks thereon on diametrically opposite sides of said pistons, two connecting rods operatively connected at one end to said cranks, respectively, and at the other ends to said movable piston on diametrically opposite sides thereof, the connections of said rods to said movable piston being on a diameter thereof lying in a plane which includes the axis of said crankshaft.

14. The apparatus of claim 13 including an annular yoke surrounding and secured to said movable piston, said yoke having two diametrally opposed wrist pins which are coaxial with respect to said piston diameter, said other ends of said rods being pivotally mounted on said wrist pins, respectively.

15. The apparatus of claim 12 wherein said stationary piston is provided with a radially extending cavity intermediate its ends which opens through one end thereof, a first part-cylindrical bearing portion in the bottom of said cavity having an axis coincident with a diameter of said pistons, a frame element received by and secured within said cavity, and said frame element having a second part-cylindrical bearing portion juxtaposed with said first bearing portion to thereby form a journal bearing for said crankshaft.

16. The apparatus of claim 15 including a housing enclosing the mid portions of said pistons, said crank arms and said yoke, said housing having first opposed sides within which opposite end portions of said crankshaft are journaled, and means for securing said stationary piston to said housing.

17. The apparatus of claim 16 wherein said means includes said frame element secured to said housing, said movable piston having longitudinally extending clearance slots on diametrically opposite sides which receive said crankshaft whereby said movable piston may reciprocate relative to said stationary piston and said crankshaft.

18. The apparatus of claim 17 wherein said stationary cylinders are secured to opposite sides of said housing having openings through which the opposite ends, respectively, of said movable piston project.

19. For use in an internal combustion engine, apparatus comprising a frame which carries two spaced apart axially aligned opposed cylinders, each cylinder having a cylindrical piston bore closed by a head, an elongated stationary piston having opposite ends and carried by said frame, said stationary piston being disposed within the cylindrical space defined by said bores and radially spaced therefrom, the opposite ends of said stationary piston being axially spaced from the heads of the respective cylinders, a movable piston interposed in the space between said stationary piston and said cylinders with the opposite end portions thereof reciprocably slidably engaging said bores, respectively, said movable piston also reciprocably slidably engaging said stationary piston and having heads on the opposite ends thereof, each piston head defining first and second variable volume chambers with the respective end of said stationary piston and the respective cylinder head, said stationary piston having passage extending between the ends thereof, first valve means on said stationary piston for controlling fuel flow from said passage to the respective first chambers as defined between the ends of said stationary piston and the respective piston heads, means providing a fuel intake which extends transversely of said movable piston and communicates with said passage, said piston heads each having an orifice therethrough, second valve means engageable with each orifice for controlling fuel flow between respective first and second chambers, fuel-igniting means mounted in each cylinder head, means for lubricating the engaged portions of said movable piston, said stationary piston and said cylinder bores, means for exhausting gases from said second chambers upon predetermined movement of said piston heads from the respective cylinder heads, said second valve means closing the respective orifices when the gaseous pressure in said second chambers is greater than that in the first chamber, respectively, and opening such orifices in response to said predetermined movement of said piston heads whereby compressed fuel in the first chambers will flow into the second chambers, respectively, said first valve means closing communication between the first chambers and said passage, respectively, when the pressure in the first chambers exceeds that in said passage as a result of the piston heads moving toward the respective ends of said stationary piston and opening communication when the pressure in said passage exceeds that in said first chambers as a result of the piston heads moving away from the respective ends of said stationary piston, and means for converting reciprocatory motion of said movable piston into rotary motion; said converting means including a crankshaft extending transversely of said stationary piston intermediate the ends of the latter and having portions journaled for rotation in said frame and stationary piston, a crank on said crankshaft disposed between said portions and further between said stationary piston and frame, and a connecting rod operatively connected between said crank and said movable piston whereby reciprocating motion of said movable piston results in rotation of said crank and crankshaft.

20. The apparatus of claim 19 wherein the point of pivotal connection of said rod with said movable piston lies on a diameter thereof in a plane which includes the axis of said crankshaft.

21. The apparatus of claim 19 wherein said shaft has opposite end portions journalled in said frame and a central portion mounted for rotation in said stationary piston, two cranks on said crankshaft on opposite sides, respectively, of said stationary piston, and two connecting rods operatively connected between said cranks and said movable piston whereby reciprocating motion of said movable piston results in rotary motion of said crankshaft.

22. The apparatus of claim 21 wherein said frame includes a housing which mounts said opposed cylinders, said opposite end portions being journaled in spaced housing sides with said pistons being disposed in spaced relation therebetween, and said two cranks being between said pistons and said sides, respectively.

23. The apparatus of claim 21 wherein said connecting rods are pivotally connected to said movable piston by means of a surrounding annular yoke secured thereto, said yoke having diametrally opposed wrist pins in axial alignment with the axes thereof coincident with a diameter of said movable piston, said diameter lying in a plane which includes the axis of the central portion of said crankshaft.

* * * * *